United States Patent [19]

Watling et al.

[11] 4,088,008

[45] May 9, 1978

[54] QUICK RELEASE ADAPTER AND TOOL COMBINATION

[75] Inventors: Leighton Harvey Watling, Camarillo; Donald R. Henthorn, Simi Valley both of Calif.

[73] Assignee: American Machine & Hydraulics, Inc., Newbury Park, Calif.

[21] Appl. No.: 788,360

[22] Filed: Apr. 18, 1977

[51] Int. Cl.[2] ..... B21D 37/04

[52] U.S. Cl. ..... 72/481; 279/76; 403/328

[58] Field of Search ..... 72/393, 477, 481; 403/317, 328, 361, 343; 279/76, 81

[56] References Cited

U.S. PATENT DOCUMENTS

| | | | |
|---|---|---|---|
| 1,779,323 | 10/1930 | Lacerda | 72/481 |
| 1,814,655 | 7/1931 | Andreasson | 279/76 |
| 2,105,391 | 1/1938 | Almdale | 72/481 |
| 2,324,852 | 7/1943 | Kopczynski | 279/76 |
| 3,832,075 | 8/1974 | Arai | 403/328 |

*Primary Examiner*—Lowell A. Larson
*Attorney, Agent, or Firm*—Ralph B. Pastoriza

[57] ABSTRACT

An adapter member is arranged to be connected between a portion of a machine and a tool to enable quick attachment and removal of the tool to the machine. One end of the adapter member connects to the machine portion and the other end terminates in a reduced diameter section defining an annular shoulder. The tool itself is provided at one end with an entrance bore telescopically receivable over the reduced diameter section of the member so that the one end seats against the annular shoulder. The entrance bore to the tool includes a first axially directed camming surface which depresses the pin or projection when the tool is telescoped over the section. A crescent shaped groove within the bore in turn runs transversely to the axis of the bore and receives the pin or projection, the same snapping into this groove when the entrance bore is fully telescopically received over the reduced section. The crescent shaped groove has a floor which slopes gradually to become flush with the interior bore so that by rotation of the tool, the pin can again be depressed and then the tool axially pulled from the end of the adapter member thereby providing the quick release feature.

4 Claims, 7 Drawing Figures

QUICK RELEASE ADAPTER AND TOOL COMBINATION

This invention relates generally to machining tools and more particularly to a combination quick release adapter and tool to facilitate attaching the tool to and removing the tool from a machine.

BACKGROUND OF THE INVENTION

In many different types of mechanical forming and shaping operations, it is only necessary that the forming tool be subject to a large loading in one direction. For example, a simple expanding die for increasing the diameter of the initial portion of a metal tubing such as an exhaust pipe need only be urged axially into the end of the pipe, all of the load being in this forward direction. While a slight force in a reverse direction may be required to remove the expanding die from the exhaust pipe or other metal tube because of friction and the like, such force is fairly small compared with the main force in forcing the die into the pipe.

Tools of the foregoing type such as an expanding die are normally secured to the machine as by simply threading the tool directly to the end of a hydraulic piston rod or similar machine portion. The work to be shaped or expanded is then clamped and the hydraulic rod will move the die axially into the tube.

Different sized dies are needed for different sized tubes or pipes to be treated and accordingly, a worker must unthread the one die and thread on another die. This attaching and removal of the dies by threading operations is time consuming and oftentimes can result in damage to the threaded portion of the machine itself necessitating complete replacement of a machine part. While mechanisms are known which allow a worker or operator to attach and detach a tool fairly quickly, such mechanisms are for the most part complex in design and costly to fabricate. A need therefore exists for an improved means or mechanism which is simple in design and economical to manufacture and yet enables very rapid attachment and removal of a tool wherein such mechanism is further capable of withstanding large loads in at least one direction and capable of preventing inadvertent separation of the tool when moved in an opposite direction.

BRIEF DESCRIPTION OF THE PRESENT INVENTION

With the foregoing in mind, the present invention contemplates a quick release adapter and tool combination particularly useful for those types of tools which are subject to a relatively large loading force in only one direction, which adapter and tool combination can be economically manufactured and is very simple to use.

More particularly, the quick release adapter and tool combination of this invention includes an adapter member having means at one end for securing it to a portion of a machine normally receiving a conventional tool and terminating at its other end in a reduced diameter cylindrical section to define an annular shoulder. This reduced diameter section includes a diametric pin radially biased outwardly to project above the surface of the section, the pin being capable of being depressed against the bias to a position flush with the surface of the section.

Cooperating with the foregoing adapter member is a tool such as an expanding die having an entrance bore at one end telescopically receivable over the reduced diameter cylindrical section of the member with the periphery of the entrance bore at the referred to one end seating on the annular shoulder so that a relatively large axial load can be exerted on the tool by the shoulder.

An end peripheral portion of the entrance bore defines a first camming surface sloping axially and radially towards the axis of the bore for depressing the pin upon telescoping of the tool over the reduced diameter section. An inside circumferential portion of the wall of the bore in turn includes a groove running transverse to the axis of the bore for receiving the pin when the tool is fully telescoped over the reduced diameter section. The floor of this groove slopes to terminate at one end of the groove in flush relationship with the inside wall of the bore to define a second camming surface.

With the foregoing arrangement, the tool can be removed from the adapter member by simply rotating the same so that the second camming surface depresses the pin thereby permitting the tool thereafter to be axially pulled free of the member.

The various tools to be used with the adapter would all be provided with similar bores at one end having the first and second described cam surfaces so that several different tools can readily be attached to or removed from the adapter, the adapter itself remaining on the operating portion of the machine.

BRIEF DESCRIPTION OF THE DRAWINGS

A better understanding of this invention will be had by referring to the accompanying drawings in which.

DETAILED DESCRIPTION OF THE PREFERRED EMBODIMENT

Figure 1:
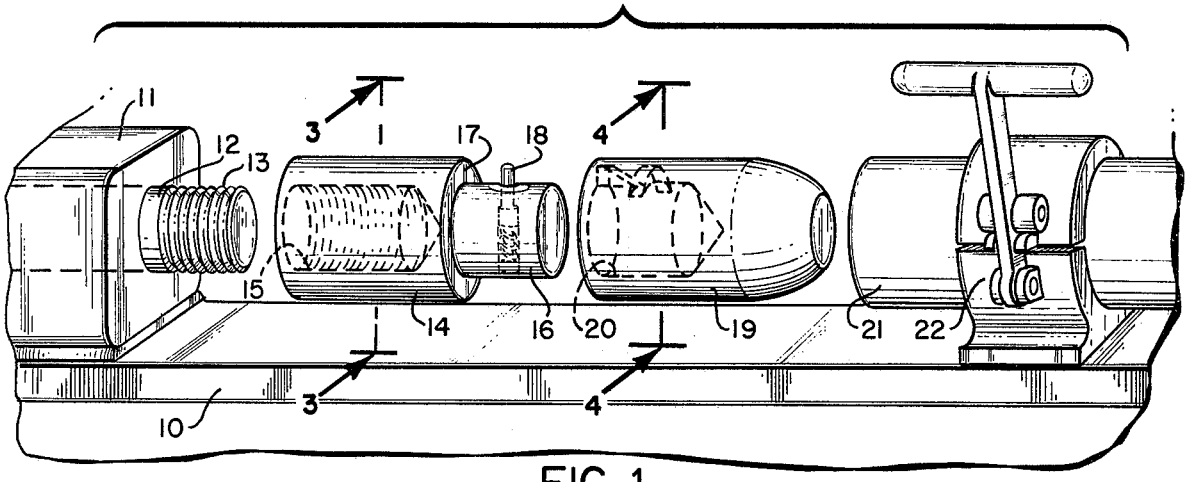
FIG. 1 is an exploded perspective view of the quick release adapter and tool combination of this invention preparatory to being utilized in a machine for expanding the end portions of tubes or pipes.

Referring first to FIG. 1 there is shown a machine for expanding the initial entrance portion of a pipe or tubing in the form of a frame 10 and hydraulic motor or ram 11. A hydraulic ram rod or piston rod 12 is shown extending from the hydraulic mechanism 11, the rod terminating in threads 13. Conventional expanding dies would normally include a threaded entrance bore at one end for receiving the threads 13 to secure the die to the piston rod 12. The piston rod 12 under hydraulic pressure would then be urged from the machine 11 in a direction to the right as viewed in FIG. 1 to force the opposite end of the die into the entrance portion of a pipe to thereby effect an expansion of the pipe. It will be appreciated that in such an operation the primary loading applied to the die would be in one direction only.

In accord with the present invention, in order to avoid the necessity of continuous threading and unthreading of dies when substituting new dies or new further finishing tools, there is provided an adapter member 14 preferably cylindrical having threads 15 at one end for threaded engagement with the threads 13 on the hydraulic piston rod 12 and terminating at its upper end in a reduced diameter section 16. The reduced diameter section 16 defines with the cylindrical member 14 a flat annular shoulder 17 facing in the direction where maximum load is to be applied.

A spring biased pin 18 is diametrically positioned in the reduced diameter section 16 so as to radially project from the section as shown. This pin is radially retractable into the section against the spring bias when pressed in a radially inward direction.

Shown in exploded view following the cylindrical adapter member 14 is a tool in the form of an expanding die 19. Die 19 has an entrance bore 20 at one end of inside diameter corresponding to the reduced diameter of the section 16 so as to be telescopically receivable over this section with the periphery of the entrance bore 20 seated in full surface contact with the annular shoulder 17. Forward force will thus be transmitted to the die 19 by way of the annular shoulder 17 when the piston rod 12 is hydraulically extended. A tube or pipe to be expanded is shown at 21 secured by an appropriate clamp 22 in axial alignment with the axis of the hydraulic piston rod 12.

With the foregoing arrangement, it will be appreciated that extension of the piston rod 12 with the member 14 secured thereto and the die 29 seating against the annular flat shoulder 17 will urge the nose of the die 19 into the open end of the pipe 21 and effect the desired initial circumferential expansion of this pipe.

Figure 2:
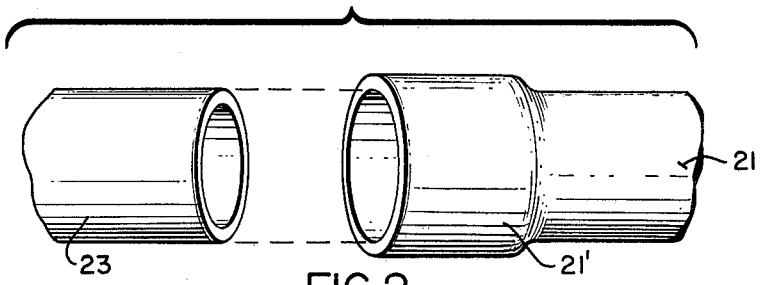
FIG. 2 is a fragmentary perspective view illustrating the resulting expanded portion of a pipe upon completion of the operation carried out by the components of FIG. 1.

FIG. 2 illustrates the expanded portion of the pipe 21 at 21'. Such an expansion might be provided, by way of example, to effect a simple connection to a further pipe section such as indicated at 23 at the same normal diameter as the pipe 21 but capable of being coupled thereto by being received within the expanded diameter portion 21'.

In effecting an expansion of the initial portion of a pipe such as described in FIGS. 1 and 2, there is normally provided some friction in withdrawing the die 19 from the end of the pipe, such friction primarily resulting from friction of the interior of the expanded portion of the pipe on the exterior cylindrical portion of the die. Accordingly, it is necessary that the die 19 be coupled to the adapter 14 in such a manner that it will be properly withdrawn from the pipe when a reverse or retracting force is applied to the adapter. However, this force of withdrawal is substantially less than that necessary to effect the expanding operation.

Figure 3:
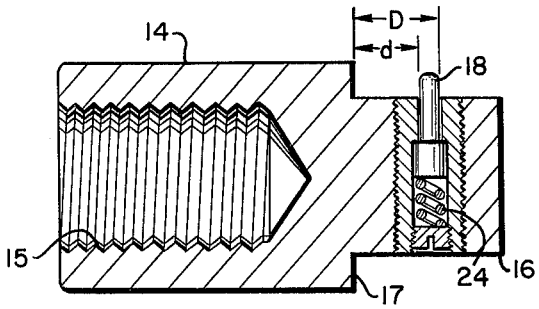
FIG. 3 is a cross section taken in the direction of the arrows 3—3 of the adapter member portion of the invention.
Figure 4:
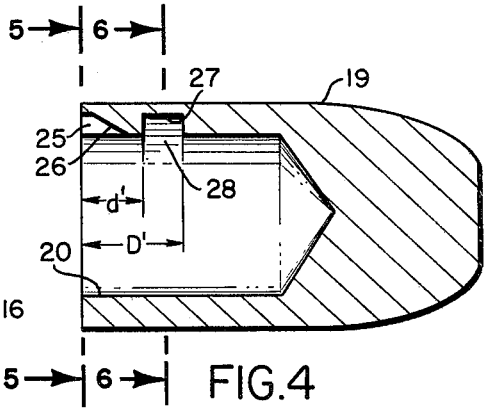
FIG. 4 is a cross section taken on the lines 4—4 of the tool component of this invention.

Referring now to FIGS. 3 and 4, it will be noted that the biased pin 18 in the reduced diameter section 16 of the cylindrical member 14 is held in a threaded insert the spring bias being provided by spring 24, the threaded insert extending diametrically through the reduced diameter section 16. In the extended position of the pin 18 as shown in FIG. 3, a first given distance is defined between the annular shoulder 17 and the near side of the pin 18, this first given distance being designated *d*. A second given distance is also defined between the far side of the pin 18 and the annular shoulder 17, this second given distance being designated D.

Referring now to FIG. 4, the tool or expanding die 19 is shown clearly in cross section wherein it will be noted that a peripheral portion of the entrance bore at the surface of the one end has a pin receiving channel 25 with a floor 26 sloping radially and axially inwardly towards the central axis of the bore 20 to terminate in flush relationship with the inside wall of the bore. This sloping floor 26 defines a first camming surface.

It will further be noted in FIG. 4, that an inside circumferential portion of the wall of the bore 20 has a crescent shaped groove 27 axially positioned beyond the sloping floor 26 defining the first camming surface. The sides of this groove are axially spaced from the one end of the bore 20 by third and fourth given distances respectively designated *d'* and D'. The floor of the crescent shaped groove slopes from a point of maximum depth to a flush relationship with the inside wall of the bore 20 at at least one end of the groove and in the preferred embodiment, at both ends.

Figure 5:
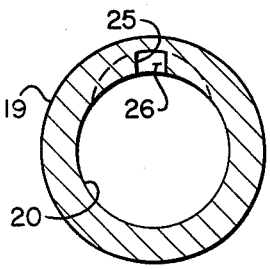
FIG. 5 is a cross section taken in the direction of the arrows 5—5 of FIG. 4.
Figure 6:
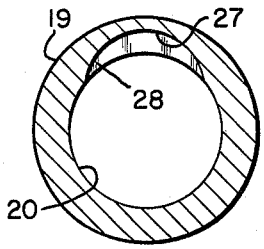
FIG. 6 is another cross section taken in the direction of the arrows 6—6 of FIG. 4; and, FIG. 7 is an enlarged fragmentary view partly in cross section showing the adapter and tool in assembled relationship.

The foregoing can better be understood by referring to FIGS. 5 and 6. In FIG. 5, the crescent shaped groove floor is indicated in phantom lines and in FIG. 6 in full lines. From the showing of FIG. 6 it will be evident that the floor slopes at both ends to merge into a flush relationship with the inner wall of the central bore 20, this floor portion 28 defining a second camming surface extending circumferentially or transversely to the first camming surface defined by the sloping floor 26 described in FIG. 4.

Figure 7:
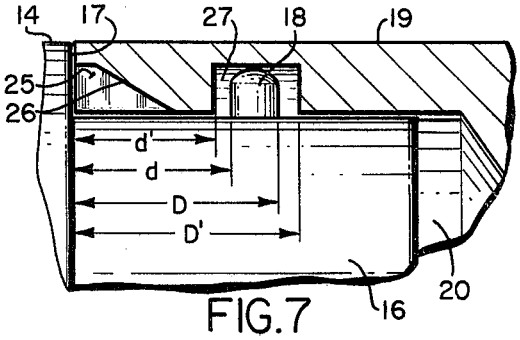

Referring not to FIG. 7, the entrance bore 20 of the expanding die tool 19 is shown completely telescoped over the reduced diameter section 16 of the cylindrical member 14. It will be evident that by aligning the channel 25 at the periphery of the bore opening 20 with the pin 18, the pin 18 will be depressed by the first cam surface defined by the sloping floor 26 to become flush with the reduced diameter section 16 and when the end of the die 19; that is, the peripheral portion of the entrance bore seats on the annular shoulder 17, the pin 18 will be positioned to snap radially outwardly into the groove 27.

From the view of FIG. 7, it will be evident that a large loading may take place against the die 19 in a right hand direction as viewed through the annular shoulder 17 and its bearing relationship with the die. In order that the pin 18 will be appropriately received in the crescent shaped groove 27, it is essential that the first and second given distances *d* and D each be greater than said third given distance *d'* and each be less than said fourth given distance D'. Further, by assuring that the second given distance D is less than the fourth given distance D', no loading will be carried by the pin 18 in the load direction. These relative distances are all clearly depicted in FIG. 7.

OPERATION

In operation, and with reference first to FIG. 1, the cylindrical adapter member 17 is simply threaded onto the end of the piston rod 12 and may remain more or less permanently in this secured position.

When it is desired to affix an expanding die or similar tool, the entrance bore 20 is simply telescoped over the reduced diameter section 16 making sure that the pin 18 is in alignment with the channel 25 on the peripheral portion of the entrance bore 20, all as described with respect to FIGS. 3 and 4. The first camming surface in the form of the sloping floor 26 will readily depress the pin 18 as the die is completely telescoped into a position wherein the end seats on the annular flat shoulder 17. In this fully telescoped position, the pin 18 is free to snap upwardly into the crescent shaped groove 27.

An expanding operation may now be carried out and the entire load in urging the die into the end of a pipe such as the pipe 21 in FIG. 1 is borne through the annular shoulder 17 and the engaging portion of the one end of the die. After the expansion has been completed, and the hydraulic piston rod 12 withdrawn or moved to the left, the die 19 will be removed from the pipe or tube, the pin 18 bearing against the nearer side wall of the crescent shaped groove 27 to pull the die in a leftward direction as viewed in FIG. 1. Since the withdrawal load is substantially less than the applied load in the expanding operation, the pin 18 can easily withstand this reduced loading in the reverse direction.

To remove the die 19 for purposes of inserting a further finishing expansion tool or another expanding die for a different sized pipe, it is only necessary to rotate the die relative to the reduced diameter section 16 thereby causing the second camming surface 28 formed at the ends of the crescent shaped groove to depress the pin 18 into the reduced diameter section 16. Thereafter, the die can simply be axially pulled free of the reduced diameter section 16.

Where the crescent shaped groove has its floor portion merging into the inside wall of the bore 20 at both ends, rotation of the die 19 in either direction an amount corresponding to the circumferential extent of the groove will result in camming of the pin 18 back into the reduced diameter section 16 and thereafter allow axial removal. Since the crescent shaped groove circumferentially extends for a distance less than 180° as is clearly shown in FIGS. 5 and 6, it is never necessary to rotate the die more than one half a revolution to effect its removal.

The specific design for the die 19 can be very economically carried out, it only being necessary to provide the initial bore 20 in the die as opposed to cutting threads for direct attachment to the hydraulic rod 12. Thereafter, the first camming surface can easily be formed by a very short machining operation and the second camming surface defined by the crescent shaped groove further easily milled by simply introducing a reduced diameter milling wheel into the bore 20 and then moving the axis of the milling wheel upwardly.

The provision of the spring biased pin 18 is economical inasmuch as such pins are normally available as shelf items already encased within the threaded carrier as disclosed in FIG. 3. It is thus only necessary to drill and tap the necessary diametric hole through the reduced diameter section 16.

It will, of course, be understood that all tools to be used with the adapter will be provided with identical central bores and camming surfaces although the remaining portions of the tools or dies may have different dimensions depending upon the particular metal forming operation to be carried out.

It will be evident from the foregoing description that the present invention has provided a quick release adapter and expanding tool combination which will save substantial time in various machining operations in that any particular tool can be quickly attached to a machine and removed from the machine as is necessary.

I claim:

1. A quick release adapter and tool combination to facilitate attaching the tool to and removing the tool from a portion of a machine in which an axial load is to be exerted on the tool which is substantially greater in one direction than the opposite direction, including:

(a) a member having means at one end for securing it to said portion of said machine and terminating at its other end in a reduced diameter cylindrical section to define an annular shoulder facing in said one direction, a surface portion of said reduced diameter section including a diametric pin radially biased outwardly to project above said surface portion, said pin being capable of being depressed to a position flush with said surface portion; and (b) a tool having an entrance bore at one end telescopically receivable over said reduced diameter cylindrical section with the periphery of said entrance bore seating on said annular shoulder so that a relatively large axial load can be exerted on said tool by said shoulder, an end peripheral portion of said entrance bore defining a pin receiving channel having a first camming surface sloping axially and radially for depressing said pin upon telescoping of said tool over said reduced diameter section, an inside circumferential portion of the wall of said bore including a groove running transverse to the axis of said bore for receiving said pin when said tool is fully telescoped over said reduced diameter section to thereby hold said tool on said member, the floor of said groove sloping to terminate at one end of the groove in flush relationship with said inside wall of said bore to define a second camming surface so that said tool can be removed from said member by rotating the tool relative to said reduced diameter section so that said second camming surface depresses said pin thereby permitting the tool to be axially pulled free of said member.

2. A quick release adapter and tool combination for use with an hydraulic piston rod terminating in threads for threaded coupling to a conventional tool, including:

(a) a cylindrical member having threads at one end for threaded engagement with the threads on said hydraulic piston rod and terminating at its other end in a reduced diameter section defining a flat annular shoulder;

(b) a spring biased pin diametrically positioned in said reduced diameter section so as to radially project from said section with its near side at a first given distance from said annular shoulder and its far side at a second given distance from said annular shoulder, said pin being radially retractable into said section against the spring bias when pressed in a radially inward direction; and (c) a tool having an entrance bore at one end of inside diameter corresponding to the reduced diameter of said section so as to be telescopically receivable over said section with the periphery of said entrance bore seated in full surface contact with said annular shoulder, a peripheral portion of said entrance bore at the surface of said one end having a pin receiving channel with a floor sloping radially and axially inwardly toward the central axis of said bore to terminate in flush relationship with the inside of said bore, said floor defining a first camming surface; and an inside circumferential portion of the wall of said bore having a crescent shaped groove axially positioned beyond said first camming surface with sides axially spaced from said one end of said bore third and fourth given distances respectively and extending over a given circumferential distance less than 180°, the floor of the groove sloping from a point of maximum depth to a flush relationship with said inside wall of said bore at at least one end of said crescent shaped groove to define a second camming surface, said first and second given distances each being greater than said third given distance and each being less than said fourth given distance whereby said tool can be telescoped over said reduced diameter section by aligning said first camming surface with said pin, said first camming surface depressing said pin so that when said one end of said tool is seated on said flat annular shoulder, said pin can snap outwardly into said crescent shaped groove to thereby held said tool on said cylindrical member, said tool being removable from said member by rotating the tool less than 180° through at least said given circumferential distance to cause said camming surface to depress said pin to a position flush with the exterior of said reduced section, so that said tool can then be pulled in an axial direction away from said flat annular shoulder free of said cylindrical member.

3. The combination of claim 2, in which the point of maximum depth of said crescent shaped groove is halfway between the ends of the groove, said floor of said groove sloping to a flush relationship with said inside wall of said bore at both ends of said groove so that removal of said tool can be accomplished by rotating the tool in either direction to depress said pin.

4. The combination of claim 2, in which said tool is a tube forming die.

* * * * *